United States Patent [19]

Iguchi et al.

[11] 4,114,427

[45] Sep. 19, 1978

[54] APPARATUS FOR ACCURATELY MEASURING THE FREENESS OF PAPER STOCK FLOWING IN A FEED PIPE

[75] Inventors: Yoshio Iguchi, Shizuoka; Chuichi Honma; Takesi Itoh, both of Tokyo; Kazutaka Hosokawa, Odawara, all of Japan

[73] Assignee: Honshu Seishi Kabushiki Kaisha, Tokyo, Japan

[21] Appl. No.: 664,358

[22] Filed: Mar. 5, 1976

[30] Foreign Application Priority Data

Apr. 18, 1975 [JP] Japan ..... 50-46513

[51] Int. Cl.[2] ..... G01N 11/06; D21F 1/08

[52] U.S. Cl. ..... 73/63; 73/422 TC; 137/92; 162/258; 162/263; 366/101

[58] Field of Search ..... 73/63, 422 TC, 6; 162/198, 49, 263, 258, 254; 137/92, 93; 259/DIG. 17, 147; 366/101

[56] References Cited

U.S. PATENT DOCUMENTS

| | | | |
|---|---|---|---|
| 1,838,614 | 12/1931 | French et al. | 73/63 |
| 1,970,521 | 8/1934 | Harvey | 73/63 |
| 2,826,061 | 3/1958 | Furster et al. | 73/63 |
| 3,058,672 | 10/1962 | Zabel | 162/263 |
| 3,115,782 | 12/1963 | Echtler, Jr. | 73/422 TC |
| 3,659,461 | 5/1972 | Thompson | 73/422 TC |
| 3,726,143 | 4/1973 | Enarrson | 73/423 TC |
| 3,846,231 | 11/1974 | Crosby et al. | 162/263 |

FOREIGN PATENT DOCUMENTS

| | | | |
|---|---|---|---|
| 858,223 | 12/1970 | Canada | 73/63 |

*Primary Examiner*—Richard V. Fisher
*Assistant Examiner*—Steve Alvo
*Attorney, Agent, or Firm*—Wenderoth, Lind & Ponack

[57] ABSTRACT

An apparatus for accurately measuring the freeness of paper stock in a short time is disclosed.

The apparatus comprises a pump and plunger which take a sample of stock from a flowline or a place in which paper stock is prepared and places the sample in an agitation tank. A water supply dilutes the sample in the agitation tank to a predetermined consistency and a first pressurized air supply agitates the diluted sample so that fibrous material in the stock is evenly dispersed in the water. The agitation tank is closed to the atmosphere and a second pressurized air supply provides a pressure in the tank for draining the liquid from the sample through a screen. The liquid which passes through the screen is delivered to a measuring cylinder.

5 Claims, 3 Drawing Figures

APPARATUS FOR ACCURATELY MEASURING THE FREENESS OF PAPER STOCK FLOWING IN A FEED PIPE

BACKGROUND OF THE INVENTION

This invention relates to a method and an apparatus for measuring freeness of paper stock to be fed to a paper machine during paper making process. This freeness indicates the rate of drainage of the stock on wire cloth of the paper machine. The method and apparatus makes it possible to automatically and continuously measure the freeness of the stock on the way to the paper machine or at a place where the stock is prepared.

Previously, paper stock has been treated by a beater or other similar refining equipment. The extent of beating has been measured by taking out a test sample of the stock from the beater and measuring the freeness thereof by a conventional freeness tester such as a Schopper-Riegler or Canadian Standard type freeness tester; the beating has been continued until the desired degree of beating is obtained. Recently, the refining process has been improved so that it can be performed continuously and automatically; furthermore, refined stock is sent to machine room directly and automatically. Thus, it has become necessary to measure the freeness automatically during the process, for example by taking out a sample from a feeding pipe connected to the paper machine room or from stock chest at an intermediate portion of the feeding pipe. Thus the freeness measurement of the stock in the continuous flowline now employs the steps of periodically sampling from the feeding pipe an adequate amount of sample, screening the sample and measuring the filtrate or screened water, by volume or weight, which passes through a screen during a predetermined time (usually 10 to 60 seconds). The quantity of filtrate is the index of freeness.

However, in the conventional measuring system mentioned just above, the value of the freeness varies according to variance in consistency and/or temperature of the stock. Therefore, the consistency and the temperature of the stock must be inspected from time to time and the obtained value of the freeness must be adjusted for these factors. Furthermore, according to such a measuring system, accurate measurement of the freeness of any paper stock which has been refined or beaten to a considerably high degree is impossible, since in such stock the difference in freeness is hardly detectable even if the degree of refining or beating treatment of the stock is changed.

A similar method is also applied in the feeding pipe by introducing the paper stock into a freeness tester by means of fluid pressure in the feeding pipe, and measuring the quantity of filtrate passing through a screen during a predetermined time. In such a way, the filtrate must be discharged and the fibrous mat of the paper stock left on the screen must be removed before the next test begins. However, the filtrate contains fine fibers and size, and counter flow cleaning causes the fine fibers and size to stick to the back side of the screen. Such a phenomenon is likely to cause error in the next test. Therefore, the screen must be dismounted and cleaned from time to time and the consistency of the stock in the feeding system is varied because of white water flow into the feeding pipe.

SUMMARY OF THE INVENTION

This invention is to eliminate the aforementioned problems in the measurement of the freeness of stock which flows in a continuous feeding line.

Therefore, an object of the invention is to provide a method and an apparatus for measuring the freeness in which there is substantially no error in test data resulting from variation in consistency and/or temperature of the stock.

Another object of the invention is to provide a method and an apparatus for measuring the freeness in which the obtained data gives an accurate indication of the rate of refining or beating of the stock which has been refined to a relatively high degree.

A still further object of the invention is to provide a method and an apparatus for measuring the freeness of stock in which a sample taken out in every test is discharged out of the stock feeding line without adversely affecting the consistency of stock in the feeding line; and the stock stuck to a filter screen may be also completely removed.

For achieving the aforementioned objects, in this invention, a collected sample is diluted with water. For accurate measurement, it is necessary to uniformly disperse stock in the water. In this invention, the uniform dispersion is obtained in short time by injecting pressurized air into the suspension. Hitherto, in the technical field of the paper making, especially measurement of the freeness, it has never been considered to agitate such suspension by using pressurized air thereinto since air bubbles adhere to the fibers in the suspension. However, the inventors of this application confirmed that even if air is employed for agitation, accurate measurement of freeness can be performed by maintaining constant air blowing conditions such as pressure and quantity of the air and also keeping constant consistency of the stock. The thus obtained liquid in which the stock is evenly diluted by the agitation of the air is then filtered or drained through a screen. Preferably, slight pressure is applied to the stock suspension liquid during this filtration. The freeness of the stock is measured as the quantity of the liquid which has drained from the slurry or stock suspension liquid in a predetermined time. After the measurement, the apparatus is fully flushed by water suppled by water jet nozzles at least one of which is to direct a jet of cleaning water on the back side the screen. Thereafter, all liquid in the apparatus, including the cleaning water, is fully discharged from the apparatus.

According to the present invention, since the test sample is diluted, variations in the consistency and temperature of the diluted sample are negligible, even if the consistency and temperature of the stock in the flow line varies substantially. Thus, accurate test results may be effected. If underground water, the temperature of which is relatively invariable is used, the feature mentioned just above is made even more significant. Still better results may be obtained by using water of constant temperature. By the dilution as mentioned above and in addition thereto the screening of the diluted sample, preferably under slight pressure, the difference in the freeness can be sensed according to the difference in the degree of refining of the stock even in the measurement of the freeness of the stock refined to a considerably high degree, measurement of which has hitherto been impossible. Furthermore, in accordance with the present invention, the uniformity of the diluted suspension is obtained in a short time by air agitation. While this invention realizes the aforementioned superior advantages, a full test cycle is performed in short time. The time for a test cycle is shortened further if the screening is operated under slight pressure.

The features of the invention will be made clear in more detail by the following description referring to the accompanying drawings.

DETAILED DESCRIPTION OF THE INVENTION

Figure 1:
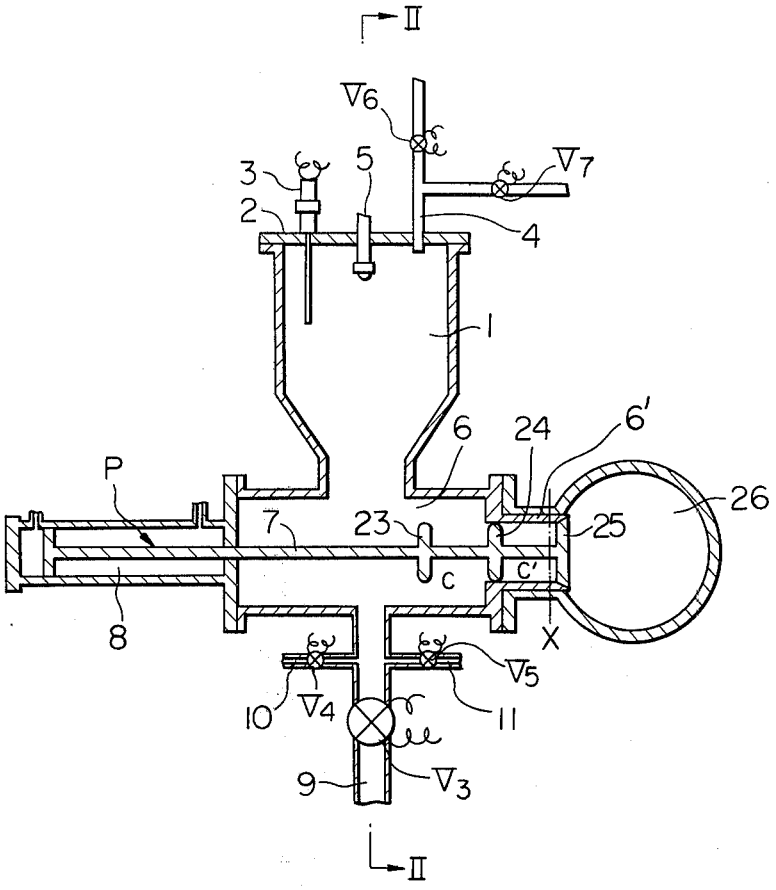
FIG. 1 is a sectional view showing a portion of an example for diluting and agitating a test sample in this invention.
Figure 2:
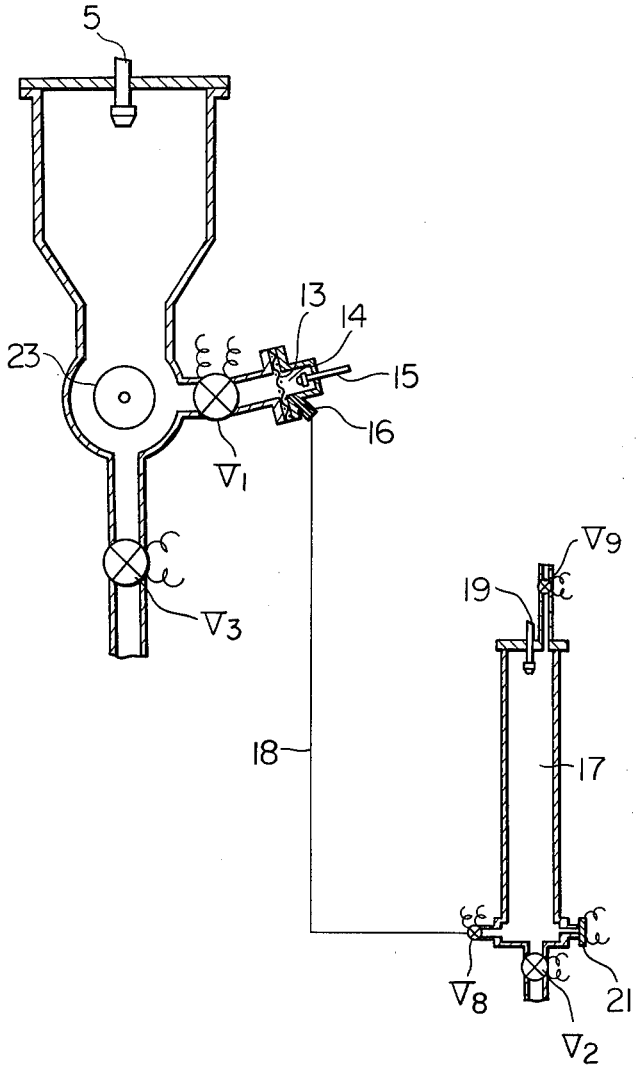
FIG. 2 is a schematic illustration showing the relation between the portion for dilution and agitation which is taken along the line II—II in FIG. 1 and a cylinder for measuring the quantity of liquid.

Referring to FIG. 1, the apparatus for measuring the freeness according to this invention comprises a dilution and agitation tank 1 having a lid 2 on which a liquid level sensor 3, a pipe 4 for introducing pressurized fluid and a water jet nozzle 5 for flushing the interior of the tank are mounted. The lower portion of the tank forms a cylindrical portion 6 which is normally attached to a stock feeding pipe 26. A plunger 7 of a pump P for taking out a test sample is associated with the cylindrical portion 6. The plunger 7 is operated by an actuating cylinder 8. At the center of the bottom of the cylindrical portion 6, a drain pipe 9 is attached which is provided with a pipe 10 for supplying dilution water and a pipe 11 for pressurized air for agitation. As is shown in FIG. 2, a screen 13 for measuring the freeness is connected to the side portion of the cylindrical portion 6 with a communication valve V1 therebetween. At the back side of the screen 13, a filtrate case 14 is fitted, which is provided with a water jet nozzle 15 for flushing the screen and a filtrate outlet 16 at the bottom thereof.

A cylinder 17 for measuring the quantity of the filtrate is made of transparent material such as glass or plastic and is provided with a scale. At the bottom of the measuring cylinder 17, a filtrate conduit 18 is provided and is connected with the outlet 16. The measuring cylinder 17 has a cleaning water jet nozzle 19 at the lid thereof and a drain valve V2 at the bottom thereof. A drain valve V3 is provided in pipe 9 which works in the same manner as that of valve V2. These valves are adapted to be automatically opened and closed by suitable sequencing means. While any conventional device may be used for measuring the quantity of the liquid in the measuring cylinder, in the embodiment illustrated in the drawings, the quantity of the liquid accumulated in the measuring cylinder 17 during a predetermined time period is determined by a low pressure gauge 21 provided at the bottom of the cylinder. In such case, it is possible to obtain electric signals by an electrical transducer and to indicate the output by a pointer needle.

In the procedure for the freeness test, a valve V4 is first released to introduce water through the dilution water pipe 10 into the dilution and agitation tank 1 until a predetermined amount of the water is obtained. The predetermined amount is sensed by the liquid level sensor 3. Even if stock of different consistency is fed through feeding pipe 26, either of following two procedure can be adopted. One is to keep the consistency of the diluted sample constant by adjusting the quantity of the dilution water according to the consistency of the stock through re-setting of the liquid level sensor. The other is to keep the quantity of the dilution water constant allowing the consistency of the diluted sample to vary according to the variation in the consistency of the stock and to calibrate the test data against the consistency of the stock. Then, a fixed amount of the paper stock fed through the feeding pipe 26 is taken out therefrom and introduced into tank 1 by the actuation of the plunger 7 of the sample take out pump P. Thereafter, pressurized air for agitating of the paper stock is injected into the tank through the air pipe 11 by opening a valve V5, whereby the stock are evenly dispersed in the water. During the introduction of the air, the air is released to the atmosphere through a pipe 4 by opening a valve V6 so that the interior of the tank is kept off air pressure during air agitation.

Figure 1A:
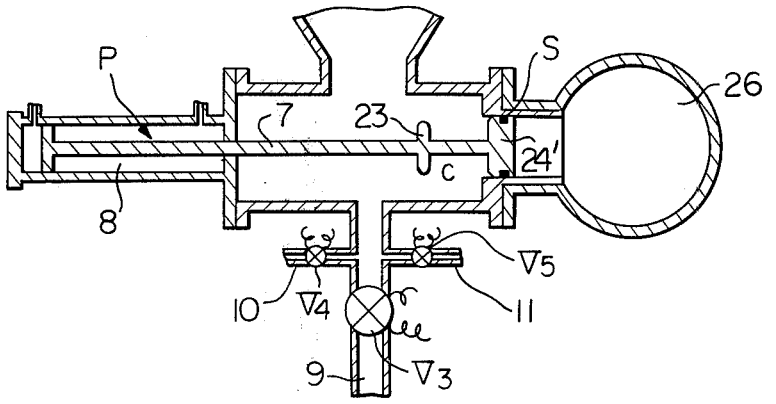
FIG. 1A is a sectional view of a modification of the plunger of the pump employed in the apparatus shown in FIG. 1.

Any type of pump may be applied to the stock sampling. The pump P illustrated in FIG. 1 is one example in which the sample gathering portion C is defined by discs 23 and 24 mounted on the plunger 7. The size and configuration of the discs 23 and 24 are such that they intimately and slidably engage the inner wall of a sample quantifying portion 6' provided as a part of the cylindrical portion 6. When a sample is to be taken out, the plunger is shifted rightward by the effect of the fluid introduced into the cylinder 8 to the extent that disc 23 reaches the position indicated by dotted line X, whereby portion C is exposed in the stock in the flowing line 26. Then, the plunger 7 is returned to the initial position. Quantification of the sample is effected when both of the discs 23 and 24 reside in the quantifying portion 6' on the return stroke of the plunger. By this quantification, a fixed amount of sample is introduced into the tank 1. The disc 25 forms a cover for positively preventing the stock in the feeding pipe from going into the tank 1 even if the pump is left in an inoperative position for a long time. The disc 25 may be eliminated by modifying the plunger to the structure shown in FIG. 1A in which a disc 24' is accompanied with a seal member such as an oil seal S which is excellent in sealing function and enhances the sealing effect thereof.

After all the sample has been put into the tank 1, pressurized air is supplied to the tank for a predetermined time. Agitation by pressurized air insures that the components in the sample stock are evenly dispersed in the water in the tank 1 (including the cylindrical portion 6), and a uniform dispersion is obtained in a short time. Thereafter, the valve V1 communicating with the case 14 is opened and thereupon the interior of the apparatus is isolated from the atmosphere by closing the valve V6. At the same time, slight pressure is caused by opening a valve V7 through the air intake pipe 4 and under such conditions, the sample is screened through the screen 13. The liquid which passes through the screen 13 is delivered to the measuring cylinder 17 through an outlet 16 and a conduit 18. After a predetermined time, the supply of the pressurized air is stopped and the valve V8 at the inlet of the cylinder 17 is closed. Now, the freeness can be obtained by measuring the quantity of liquid in the cylinder 17. The quantity of liquid in the cylinder may be measured by sensing the pressure relating to the quantity of the liquid by the pressure gauge positioned at the bottom of measuring cylinder 17 and transforming the sensed pressure into electric signals to supply as an input to a recorder, or by feeding air to the measuring cylinder through the valve V9 and measuring the back pressure thereof.

Upon completion of the test or measurement, the valves V2 and V3 associated with the drain pipes, respectively, are opened. At the same time, flushing water is spouted from the water nozzles 5, 15 and 19 for cleaning the dilution and agitation tank 1 (including cylindrical portion 6), screen 13 and measuring cylinder 17. The wash liquid remaining after the cleaning is discharged from the system through the drain valves. During the cleaning, the screen 13, which is the most important part of the apparatus, is cleaned by the nozzle 15 which is positioned at the back side area of the screen and arranged to be normal to the surface of the screen. Therefore, the components of the paper stock which have been deposited on the screen 13 to form a mat are easily peeled therefrom and discharged from the apparatus. The flush water is stopped after sufficient cleaning, and the drain valves V2 and V3 and the valve V1 communicating with the measuring device are closed for the subsequent cycle of the test. The operations explained above may be effected automatically and repeatedly by suitable sequence control means.

In the test, the quantity of water used for dilution and the quantity of air used for agitation is varied according to differences in the kinds of cellulose used, degree of refining or beating treatment and the consistency of the stock. Generally, a standard wire screen are used. The optimum test conditions can be achieved by selecting a screen of appropriate mesh. By using a screen which is the same as that actually used in a paper machine, the test may be adapted to meet the actual production.

One example of test conditions using the apparatus of this invention is listed in the table given below.

| items | condition |
|---|---|
| consistency of sample | 0.1 – 0.3% |
| pressure of air used for agitation | 3 – 5 kg/cm$^2$ |
| air pressure for screening | 0.1 – 0.2 kg/cm$^2$ |
| pressure of flushing water | 3 – 6 kg/cm$^2$ |
| dimension of apertures of screen | 177$\mu$ |

The draining portion is not arranged to be vertical or horizontal but is inclined to some extent as shown in the drawings so that the outlet 16 is positioned at the lowermost portion thereof. By this arrangement, all of the screened or drained liquid can be fed from the measuring portion to the measuring cylinder thereby minimizing test error. Furthermore, if water for industrial usage such as underground water and constant temperature water is used, the error in the test result is limited to within 1%. Furthermore, the method and the apparatus enables one to accurately test the freeness of the stock which is treated or refined to considerably high degree.

What is claimed is:

1. An apparatus for measuring freeness of fibrous material in paper stock flowing in a feed pipe, said apparatus comprising:

a closed dilution and agitation tank connected to said feed pipe, said tank having a quantifying portion connecting the interior of said pipe to the interior of said tank;

pumping means movably fitted through said tank and quantifying portion thereof into said feed pipe for removing a predetermined amount of stock from said feed pipe to said tank, said pump means comprising:

a plunger movably fitted through said tank, through said quantifying portion and into said feed pipe, said plunger having two spaced discs thereon slidably engaging said quantify portion, said discs spaced from each other a distance less than the length of said quantifying portion and at least one of said discs always engaging said quantifying portion; and moving means for moving said plunger and said discs back and forth from said feed pipe to said tank through said quantifying portion, whereby moving said plunger back and forth causes the stock in said feed pipe to fill the space between said discs and be quantified during the movement of said space from a position in said feed pipe to a position in said tank through said quantifying portion;

water supply means connected to said tank for supplying water thereto;

first air supply means connected to said tank for injecting pressurized air into said tank and agitating the fluid in said tank from said water supply means and said feed pipe;

conduit means connected to said tank for withdrawing said water and paper stock from said tank;

screening means positioned within said conduit means for screening the fibrous material of said paper stock flowing through said conduit;

measuring means connected to said conduit means on the downstream side of said screening means for measuring the quantity of liquid passing through said screening means;

first and second draining means in said tank and said measuring means respectively for draining the fluids contained within said tank and said measuring means;

first cleaning means in said tank for supplying water thereinto to flush said tank;

second cleaning means positioned in said conduit means on the downstream side of said screening means and directed toward said screening means for supplying a stream of water against said screening means and forcing the fibrous material collected thereon away therefrom toward said tank;

third cleaning means in said measuring means for supplying water thereinto to flush said measuring means;

exhaust means through said dilution and agitation tank for opening the inside of said tank to the atmosphere; and second air supply means for providing a pressure within said tank during the draining of the fluid suspension through said conduit means.

2. An apparatus as claimed in claim 1, wherein said first air supply means includes means which injects said pressurized air into said tank at a pressure within the range of 3 to 5 kg/cm$^2$.

3. An apparatus as claimed in claim 1, further comprising:

a liquid level sensor in said tank operatively connected to said water supply means for controlling the amount of water supplied to said tank from said water supply means.

4. An apparatus as claimed in claim 1, wherein said second cleaning means is comprised of at least one water jet nozzle directed toward said screening means.

5. An apparatus as claimed in claim 1, wherein said conduit means is comprised of a conduit connected to said tank and a valve in said conduit for controlling the flow of fluid in said conduit.

* * * * *